United States Patent [19]

Kendig

[11] 4,042,107

[45] Aug. 16, 1977

[54] RETURNABLE ROLL SHIPPING CONTAINER

[75] Inventor: Robert N. Kendig, Wilmington, Del.

[73] Assignee: ICI United States Inc., Wilmington, Del.

[21] Appl. No.: 552,069

[22] Filed: Feb. 24, 1975

[51] Int. Cl.[2] ..... B65D 19/26; B65D 19/42

[52] U.S. Cl. ..... 206/386; 206/391; 206/408; 206/414; 206/511; 108/53.3; 108/55.3

[58] Field of Search ..... 206/303, 389, 394, 397, 206/407, 408, 413, 414, 415, 416, 386, 511; 108/51, 53, 54, 55; 220/22.1

[56] References Cited

U.S. PATENT DOCUMENTS

| | | | |
|---|---|---|---|
| 1,409,160 | 3/1922 | Ehler | 220/22.1 |
| 2,059,267 | 11/1936 | Nichols | 206/416 |
| 2,474,657 | 6/1949 | Corson | 206/407 |
| 3,327,654 | 6/1967 | Duncan et al. | 108/53 |
| 3,489,274 | 1/1970 | Hughes et al. | 206/386 |
| 3,696,761 | 10/1972 | Brown | 108/53 |
| 3,828,964 | 8/1974 | Bonnot | 206/511 |
| 3,858,723 | 1/1975 | Weiss | 108/54 |

*Primary Examiner*—Ro E. Hart
*Assistant Examiner*—Joseph M. Moy

[57] ABSTRACT

Rigid shipping container for elongated articles such as rolls of plastic sheet or film. The shipping container comprises similar upper and lower rigid pallets and a pair of like or similar end plate assemblies which support the roll. The pallets have legs which are arranged so that they will interengage with the legs of another pallet of identical structure so that a vertical stack of shipping containers can be formed without lateral slippage. The positions of the end plates are adjustable to accommodate rolls of different widths.

6 Claims, 17 Drawing Figures

RETURNABLE ROLL SHIPPING CONTAINER

BACKGROUND OF THE INVENTION

This invention relates to shipping containers and more particularly to shipping containers for rolls of flexible sheet or film material.

The shipment of rolls of plastic sheet and film in corrugated boxboard cartons is a widespread practice. The plastic film is wound around a thin hollow cylindrical core and is supported at its ends by a pair of end plates. The end plates are square with each side slightly longer than the outer diameter of the roll, and incorporate a plug for inserting into the core, so that the entire weight of the roll is carried by the end plates. The carton is usually square, and the length of the carton or box is equal to or greater than the width of the roll. Dunnage is used to fill the ends of the carton when the length of the carton is greater than the width of the roll being shipped. A representative roll and carton of this type are shown in U.S. Pat. No. 3,710,539. For shipping, a plurality of rolls (usually four to nine, depending on the size of a roll), packaged in boxboard cartons as described, are placed on a pallet. The rolls are usually stacked either two or three high, and a divider sheet, which is typically made of plywood or fiberboard, is placed between adjacent layers of cartons. The cartons are stacked so that the end plates are aligned. In this way the entire weight of rolls in each stack is transmitted through the end plates to the pallet. The pallet and divider sheet may have cleats to maintain the cartons in alignment. The entire pallet load is unitized by strapping or shrink wrapping.

Packages of rolls in boxboard cartons as above have several disadvantages.

First, boxboard cartons and their contents can be damaged in various ways. There is a danger of crushing a box and damaging its contents due to shifting of a pallet load in transit. The conventional corrugated boxboard carton is not strong enough to withstand the loading imposed by the end plates of a carton stacked thereon. While the cartons are initially stacked so that the end plates of all cartons in a stack are aligned, it is difficult to maintain this precise alignment throughout shipment. The use of a divider sheet lessens but does not entirely eliminate crushing. Cartons can also be damaged by tearing due to the use of metal strapping.

Second, a plant that ships a number of widths of roll goods must either maintain an equal number of lengths of shipping cartons or use dunnage, neither of which is entirely satisfactory. The former requires a large inventory of cartons. The use of dunnage is not desirable because the dunnage may contaminate the plastic film and because the presence of end plates at positions other than the ends of the carton increases the possibility of carton failure under the end plates.

Third, the conventional boxboard packaging entails the use of considerable quantities of non-reusable materials. The boxboard carton and the divider sheet are not reusable, and the pallet is frequently not returned or reused. The use of non-reusable packaging materials in quantity present a waste disposal problem and is ecologically undesirable.

OBJECTS AND SUMMARY

An object of this invention is to provide a rigid shipping container assembly for rolls of flexible sheet and film material or the like.

A further object of this invention is to provide a rigid shipping container assembly which includes a rigid returnable pallet as a component thereof.

A further object of this invention is to provide a rigid shipping container assembly which can be used to ship rolls of flexible material of different widths.

A further object of this invention is to provide a rigid returnable pallet for shipping container assemblies.

A further object of this invention is to provide a novel end plate assembly for shipping containers.

According to this invention, there is provided a shipping container assembly for elongated articles comparing similar and preferably identical upper and lower rigid pallets, and a pair of spaced upright end plate assemblies. The end plate assemblies have inwardly extending means for supporting an elongated article such as a roll of plastic sheet or film. Each of the pallets comprises a platform, support means extending in one direction from the platform, the support means of the lower pallet extending downwardly and supporting the container. The support means are arranged so as to permit interlocking engagement between the support means of two similar but oppositely oriented pallets with the legs of another pallet of similar structure to prevent lateral slippage and thereby permit vertical stacking of a plurality of shipping containers.

THE DRAWINGS

DESCRIPTION OF THE PREFERRED EMBODIMENT

Figure 1:
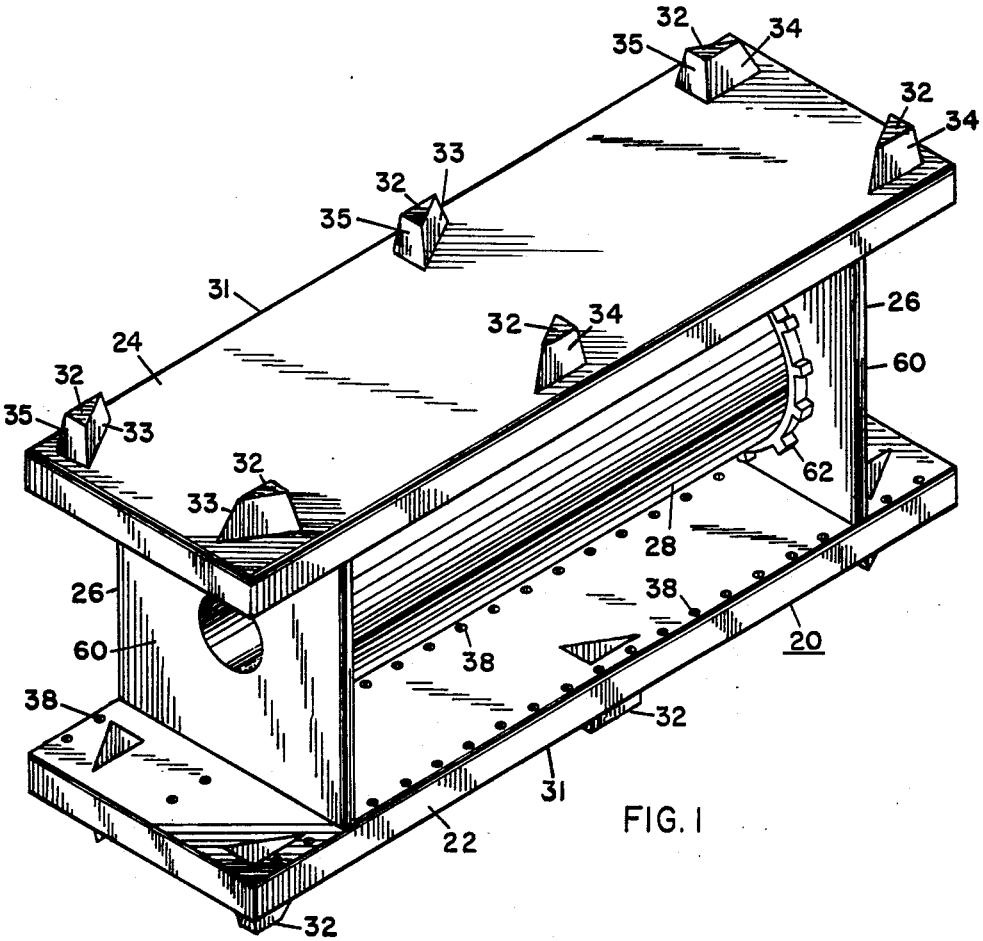
FIG. 1 is an isometric view of shipping container assembly according to a preferred embodiment of the present invention.
Figure 2:
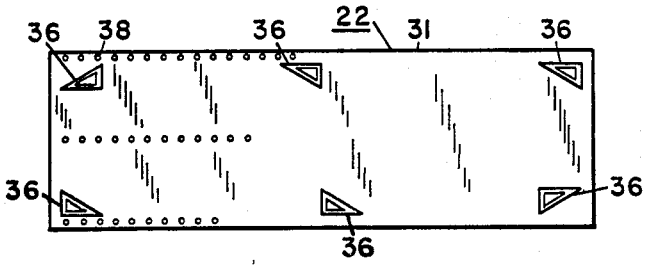
FIG. 2 is a top plan view of the pallet shown in FIG. 1.
Figure 3:
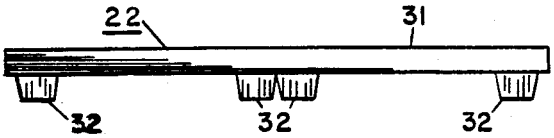
FIG. 3 is a front elevational view of the pallet shown in FIG. 1.
Figure 4:
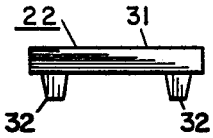
FIG. 4 is a side elevationsl view of the pallet shown in FIG. 1.

Referring to FIG. 1, 20 is a shipping container comprising a lower rigid horizontal pallet 22, an upper rigid horizontal pallet 24, and a pair of spaced upright end plate assemblies 26 which are held in place between pallets 22 and 24. Pallets 22 and 24 are structurally similar and preferably identical, but are oppositely oriented. A roll 28 of plastic film (e.g., polyester, polyethylene, or polypropylene) or other sheet or film material is wound around a core 29 (shown in FIGS. 9, 11, and 13; not shown in FIG. 1) and supported between the end plate assemblies 26. The spacing between the end plate assemblies 26 is adjustable to accommodate rolls of different widths, as will be hereinafter described.

A preferred pallet structure will now be described with reference to FIGS. 1 to 4. Pallets 22 and 24 are rigid returnable structures which are both nestable and stackable. Throughout this specification, the term "nest" and variants thereof (e.g., nesting, nestable) refers to two or more similarly oriented pallets which are fitted one within another, while the term "stack" and variants thereof (e.g., stacked, stackable) refers to a pair of oppositely oriented pallets which are placed one on top of the other in interlocking engagement. Each of the pallets 22 and 24 comprises a platform 31 having two opposite sides (i.e., an upper side and an underside), and support means, here shown as a plurality of legs 32, extending outwardly from one side of the platform. The legs 32 of lower pallet 22 extend downwardly from the underside of the platform and support the entire shipping container 20 on a floor or other supporting surface not shown. The legs 32 elevate the platform 31 sufficiently to permit the insertion of the tines of a forklift truck between the platform and the floor. The legs 32 of the upper pallet 24 extend upwardly. Thus pallets 22 and 24 are structurally similar but are oppositely oriented. The lower pallet 22 is in the upright orientation, while upper pallet 24 is in the inverted orientation. The legs 32 or other support means are arranged so as to permit interlocking engagement between the support means of two structurally similar but oppositely oriented pallets. This interlocking engagement makes it possible to stack a plurality of containers 20 vertically one above another.

Each pallet shown in FIGS. 1 to 4 has six legs, although a larger or smaller number may be provided. The legs 32 as shown are tapered with the larger ends adjacent to platform 31, and are of right triangular cross section. Each leg 32 has three inclined faces 33, 34, and 35 which are nearly but not quite vertical. Face 33 of each leg lies along the hypotenuse of the right triangle, and faces 34 and 35 lie along the other two sides. The legs 32 are located at the four corners of the platform and at point midway along the longitudinal edges of platform 31. The legs 32 are arranged asymmetrically with respect to both the longitudinal center line and the transverse center line of the pallet. Thus, the legs in two opposite corners are positioned with the right angles adjacent the corners of the platform, while the other two corner legs are positioned so that the right angles are directed inwardly. The remaining two legs (i.e., those positioned midway along the longitudinal edges of platform 31) are positioned so that each leg has one side disposed along the lateral center line of the platform with the legs extending in opposite directions from the center line. When two pallets of identical or similar structure are stacked one above the other in vertical alignment but oppositely oriented (i.e., with the legs of one pallet extending upwardly and the legs of the other extending downwardly), the opposed faces 33 of the four corner legs of each pallet engage each other in interlocking relationship that prevents lateral slippage in either the longitudinal or the transverse direction.

The legs of pallets 22 and 24 can have cross-sectional shapes other than the right triangular shape shown. For example, they may have other polygonal cross-sectional shapes, e.g., pentagonal, which present interengaging faces similar to faces 33, can be used.

Figure 17:
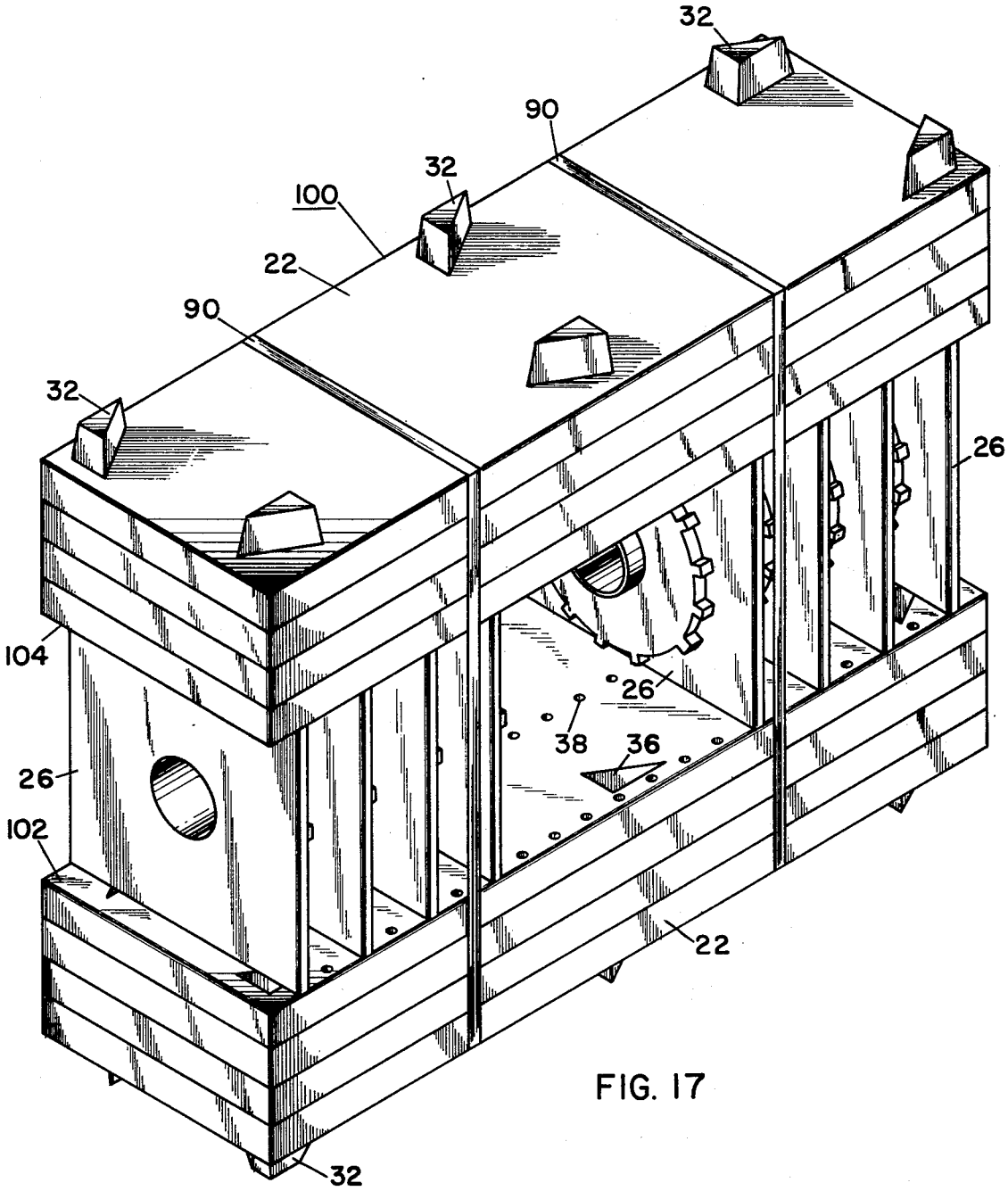
FIG. 17 is a perspective view of an assembly of pallets and end plates for return to the shipper.

The pallets 22 and 24 also each have means for permitting nesting of a plurality of like oriented similar pallets. This means includes receiving means, here shown as a plurality of triangular holes 36, in the opposite side of the platform 31 (i.e., the side opposite that from which legs 32 extend) for receiving the support means (e.g., legs 32) of another similar and like oriented pallet in nesting relationship. Holes 36 are in the upper side of lower pallet 22; the corresponding holes in the upper pallet 24 are in the underside and are not shown. Holes 36 are of the same size and shape as legs 32 (i.e., triangular in the illustrated embodiment), and are tapered downwardly and inwardly with the same angle of taper as that of legs 32. Holes 36 are situated directly above legs 32, as may be seen in FIGS. 3 and 4. This makes it possible to nest a plurality of pallets for return to the shipper as shown in FIG. 17, with the legs 32 of each pallet except the lowest fitting into the holes 36 of the pallet below.

Pallets 22 and 24 also have means for adjustably positioning the end plate assemblies 26 at a desired distance from each other. This means comprises a plurality of spaced round holes 38 for receiving end plate assemblies 26, as will be described hereinafter. Holes 38 are located in the same side of the platform 31 as holes 26. Round holes 38 are arranged in a plurality of longitudinally extending rows with a uniform spacing between the holes in each row. The spaced holes make it possible to place the end plate assemblies 26 in the positions desired, so that the space between the end plates is either equal to or less than the length of pallet 22. This makes it possible to accomodate rolls 28 of different widths.

The platform 31 is preferably flat and rectangular, and the length of platform 31 is ordinarily substantially greater than the width. The length and width of the platform must exceed the width and outer diameter, respectively, of the widest roll to be shipped. (When the elongated article to be shipped is an article other than a roll of sheet or film material, the length and width of platform 31 must exceed the length and width, respectively, of the longest article to be shipped).

Figure 5:
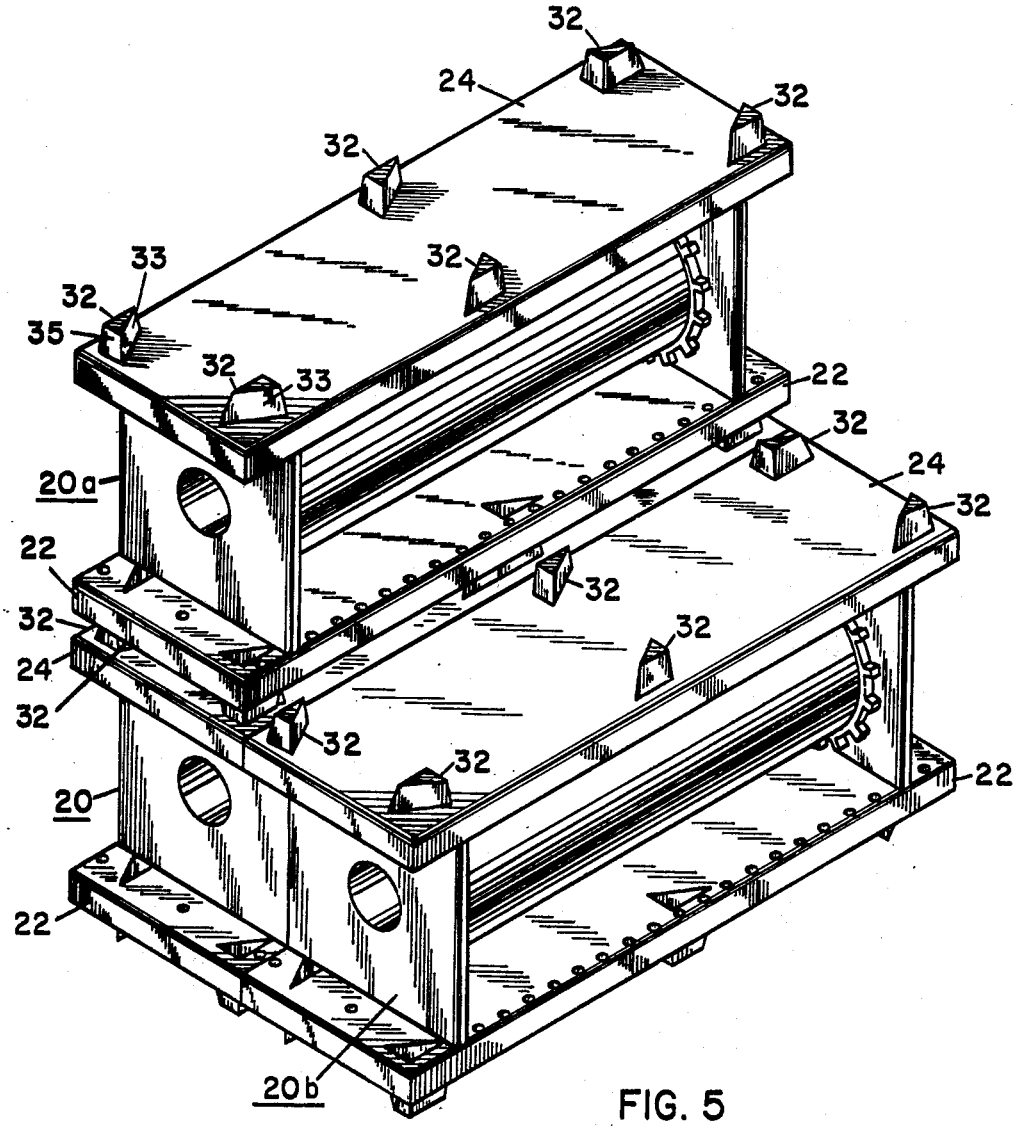
FIG. 5 is an isometric view of a multiple unit shipping assembly according to this invention, with one unit omitted.

A multiple unit shipping container assembly is shown in FIG. 5. This assembly includes three single unit shipping containers 20, 20*a*, and 20*b* of like structure. Container 20*a* is placed above container 20 so that the depending legs 32 on pallet 22 of container 20*a* engage the upwardly extending legs 32 on pallet 24. Engagement between the four corner legs of each pallet is made along the diagonal surface 33 (i.e., the hypotenuse; see FIG. 1) of each leg. This prevents lateral slippage of container 20*a*. Container 20*b* is placed alongside container 20. A fourth container, not shown, may be placed above container 20*b;* this container has been omitted for clarity in illustration. A larger number of containers can be stacked vertically one above the other or placed horizontally one beside the other if desired.

The legs 32 or other supporting means may assume various configurations which make possible the interengaging of the legs of two similar but oppositely oriented pallets. A preferred configuration is shown in FIGS. 1 to 4. Other configurations are shown in FIGS. 6 and 7.

Figure 6:
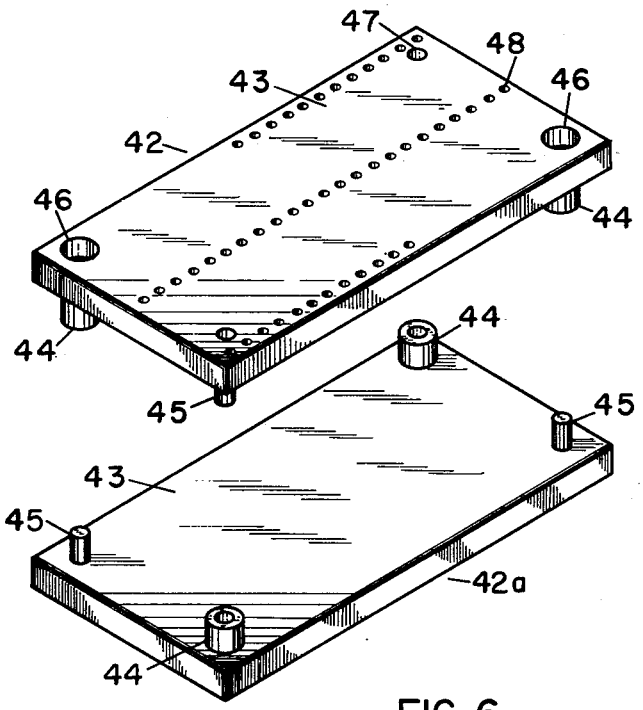
FIG. 6 is an isometric view of a pair of like but oppositely oriented pallets according to a second embodiment of this invention.
Figure 7:
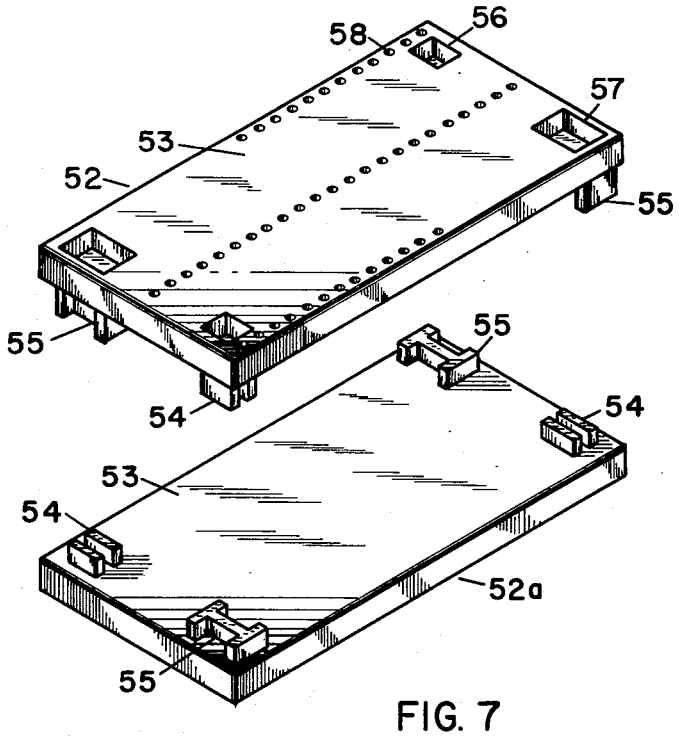
FIG. 7 is an isometric view of a pair of like but oppositely oriented pallets according to a third embodiment of this invention.

FIG. 6 shows a second pallet structure having a leg configuration which makes interlocking engagement between the legs of stacked oppositely oriented pallets possible. In FIG. 6 there are shown a pair of structurally similar but oppositely oriented pallets 42 and 42*a;* pallet 42 is upright and pallet 42*a* is inverted. Referring to FIG. 6, pallets 42 and 42*a* each have a platform 43, two annular legs 44 adjacent to two opposite corners, and two round or cylindrical legs 45 adjacent to the other two corners. All four legs extend outwardly from the same side of the platform 43, i.e., from the underside of upright pallet 42, and from the upper side of inverted pallet 42*a*. The centers of the four legs of each pallet are equidistant from the transverse center line of the platform 43. Both the annular legs 44 and the cylindrical legs 45 have cylindrical surfaces which are perpendicular to the platform 43. The inner diameter of the annular legs 44 is just slightly larger than the diameter of the round legs 45, so that the latter will fit inside the former. Pallets 42 and 42*a* also have holes 46 and 47 in platform 43 on the side opposite legs 44 and 45 to permit nesting of similarly oriented pallets. Holes 46 are of larger diameter than holes 47; holes 46 have a diameter large enough to receive annular legs 44, while the smaller holes 47 have a diameter large enough to receive cylindrical legs 45 but not to admit annular legs 44. Holes 46 and 47 in upright pallet 42 are directly above legs 44 and 45, respectively. Holes 46 and 47 are as deep as or slightly deeper than the height of legs 44 and 45, but are not as deep as platform 43. Platform 43 also has a plurality of holes 48 (shown in FIG. 6), arranged in a plurality of rows, for receiving end plate assemblies 26. (Not all of the holes 48 are shown.) Holes 46, 47, and 48 are located in the upper side of upright pallet 42, and in the underside of the inverted pallet 42*a*. (The holes in pallet 42*a* are not shown).

When pallets 42 and 42*a* are stacked, the annular legs 44 of the upper pallet 42 extend downwardly and receive the upwardly extending cylindrical legs 45 of the lower pallet 42*a*. Likewise, the annular legs 44 of the lower pallet 42*a* receive the cylindrical legs 45 of the upper pallet 42.

The pallet shown in FIG. 6 may be modified by providing legs having frustoconical surfaces instead of the cylindrical surfaces shown. This modification is particularly desirable in molded plastic pallets. The height of the legs in this modification can be greater than the thickness of the platform. This modified pallet may have, for example, two downwardly tapering frustoconical legs in place of legs 45, and two downwardly tapering annular legs, each having two oppositely sloping frustoconical wall surfaces, in place of legs 44. Additional legs may be provided if desired.

FIG. 7 shows still another pallet construction. In FIG. 7, like but oppositely oriented pallets 52 and 52*a* each have a rectangular platform 53. A pair of transverse legs 54, each consisting of two spaced parallel runners, and a pair of transverse I-shaped legs 55, each consisting of a transverse runner and two short longitudinal runners, extend outwardly from one side of platform 53 (the underside of upright pallet 52, and the upper side of inverted pallet 52*a*). Legs 54 are located in two diagonally opposite quadrants of the platform 53, and the legs 55 are located in the other two quadrants. Additional legs 54 and 55 may be provided as desired. All four legs 54 and 55 are located the same distance from the transverse center line of platform 53. The distance between the parallel runners of legs 54 is slightly greater than the width of the runners of legs 55, so that the transverse runners of legs 55 fit in the slots provided between the runners of legs 54 when two oppositely oriented like pallets 52 and 52*a* are stacked. The transverse runners of legs 54 restrain slippage of the two stacked pallets in the lengthwise direction. Sideways slippage of two stacked pallets is restrained by the end runners of I-shaped legs 55, which engage the ends of legs 54. In this way the two pallets are held in interlocking engagement with the edges of platform 53 aligned. Pallets 52 and 52*a* also have rectangular holes 56 and 57 in platform 53 for receiving the legs 54 and 55, respectively, of another similar pallet in nesting relationship. Holes 57 are larger than holes 56. Holes 56 and 57 are located in the side of platform 53 opposite legs 54 and 55; that is, holes 56 and 57 are in the upper side of upright pallet 52. Holes 56 are located directly above legs 54 and holes 57 are located directly above legs 55 in pallet 52. The depth of platform 53 must be greater than the height of legs 54 and 55 or the depth of slot means 56 and 57. Pallet 52 and 52*a* also have a plurality of round holes 58 on one side of the platform 53 (i.e., the upper side of upright pallet 52) for receiving end plate assemblies 26.

When two similar pallets 52 and 52*a* are stacked, the transverse runners of the I-shaped legs 55 of each pallet 52 fit into the slots provided by the legs 54 of the other pallet, as shown by the broken lines.

The pallet of FIG. 7 can be modified by providing tapered legs if desired. This modification is particularly desirable in molded plastic pallets.

Figure 8:
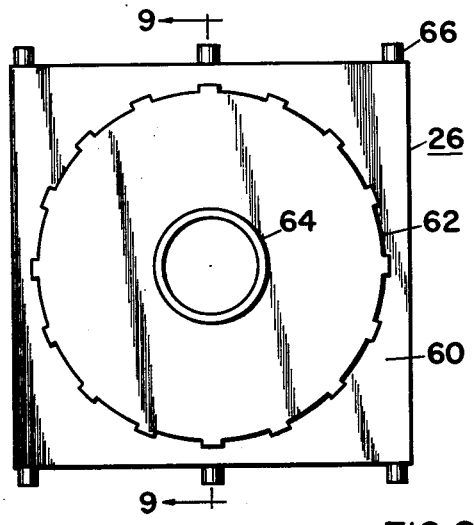
FIG. 8 is an elevational view of the inside of an end plate assembly according to one embodiment of this invention.
Figure 9:
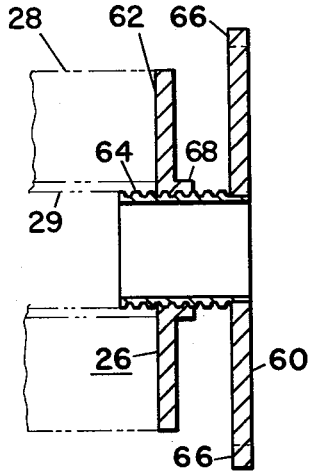
FIG. 9 is a vertical sectional view taken along line 9—9 of FIG. 8.

The details of an end plate assembly according to one embodiment of the invention will now be described with reference to FIGS. 8 and 9. Referring to FIGS. 8 and 9, there is shown an end plate assembly 26 which comprises an end plate 60, a disc 62 which is movable toward or away from the end plate 60 for holding roll 28 tightly in position, and a shaft 64 which is perpendicular to the end plate 60 and the disc 62 for guiding the movement of the disc. The end plate 60 has projections, here shown as dowel pins 66 on two opposite edges for insertion into holes 38 in pallets 22 and 24 (see FIG. 1). The end plates can be placed any desired distance apart as has been previously explained. End plate 60 also has a central opening for receiving one end of shaft 64. Shaft 64 is hollow and externaly threaded, and is rigidly secured to end plate 60. Disc 62 is rotatable and has an internally screw threaded central opening which is surrounded by an internally threaded boss 68. The internal screw threads of disc 62 and boss 68 engage the external screw threads of shaft 64 so that disc 62 moves along shaft 64 toward or away from end plate 60 as it rotates. One end of shaft 64 projects beyond the disc 62 and receives one end of roll 28. Roll 28 is wound around a core 29, as is conventional. The two ends of roll 28 are supported by the two end plate assemblies 26.

The end plate assembly construction above described will accommodate a roll 28 of any width up to the length of pallets 23 and 24. The end plates 60 are positioned so that the distance between them is slightly greater than the width of the roll 28. This is done by placing the dowel pins 46 in the appropriate holes 38 in pallets 22 and 24. Then the rotatable discs 62 are tightened against the ends of roll 28. This places the roll and the end plates in compression so that the roll is held tightly in place.

Figure 10:
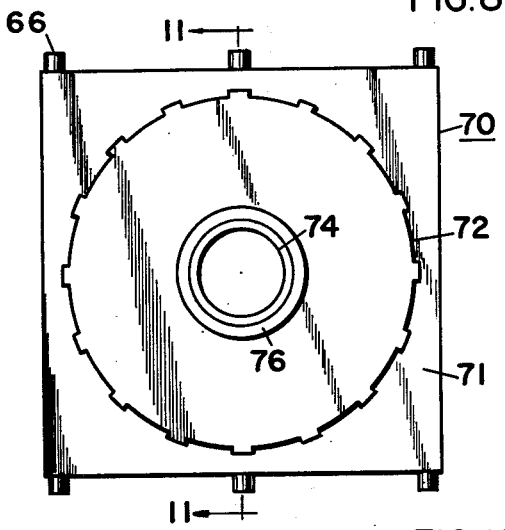
FIG. 10 is an elevational view of the inside of an end plate assembly according to another embodiment of this invention.
Figure 11:
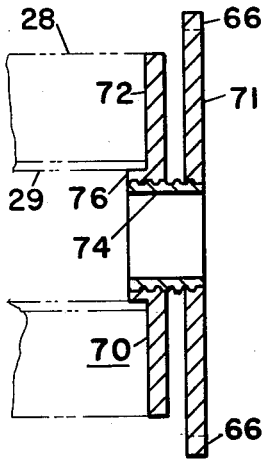
FIG. 11 is a vertical sectional view taken along line 11—11 of FIG. 10.

An end plate assembly 70 according to a second embodiment of the invention is shown in FIGS. 10 and 11. This embodiment, like that shown in FIGS. 8 and 9, includes an end plate 71 having a central opening, a rotatable disc 72 which is movable relative to end plate 71, and an externally screw threaded hollow shaft 74 which is carried by the end plate 71. End plate 71 has dowel pins 66 thereon for insertion into holes 38 of pallets 22 and 24. In this embodiment, the disc 72 has a boss 76 for supporting one end of a roll 28 and is internally screw threaded for engagement with the external screw threads on shaft 74. Rotation of the disc 72 causes axial movement of the disc toward or away from end plate 71.

Figure 12:
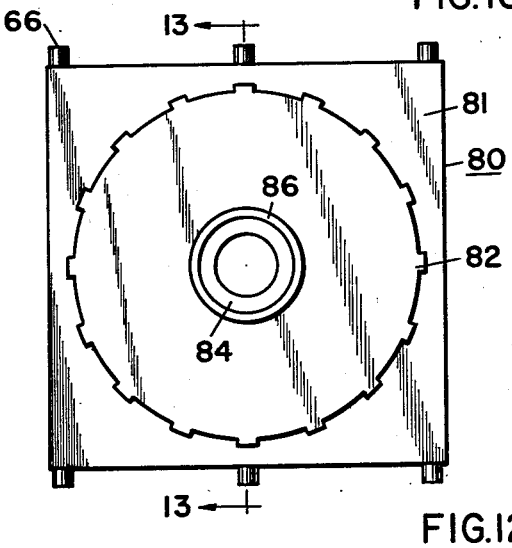
FIG. 12 is an elevational view of the inside of an end plate assembly according to a third embodiment of this invention.
Figure 13:
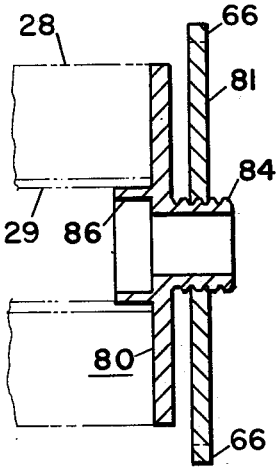
FIG. 13 is a vertical sectional view taken along line 13—13 of FIG. 12.

A third end plate assembly according to this invention is shown in FIGS. 12 and 13. According to this embodiment of the invention, the end plate assembly 80 includes an end plate 81 having a central opening that is internally screw threaded, and a disc 82 that has an externally screw threaded hollow shaft 84 extending therefrom in one direction and a boss 86 extending therefrom in the opposite direction. End plate 81 has dowel pins 66 thereon for insertion into holes 38 of pallets 22 and 24. The screw threads on shaft 84 engage those in the opening in end plate 81 to permit axial movement of the disc 84 toward and away from end plate 81 as disc 82 rotates. The boss 86 supports one end of a roll 28 of sheet or film material.

Any of the pallet structure herein can be used with any of the end plate assemblies herein in assembling a shipping container according to this invention.

Figure 14:
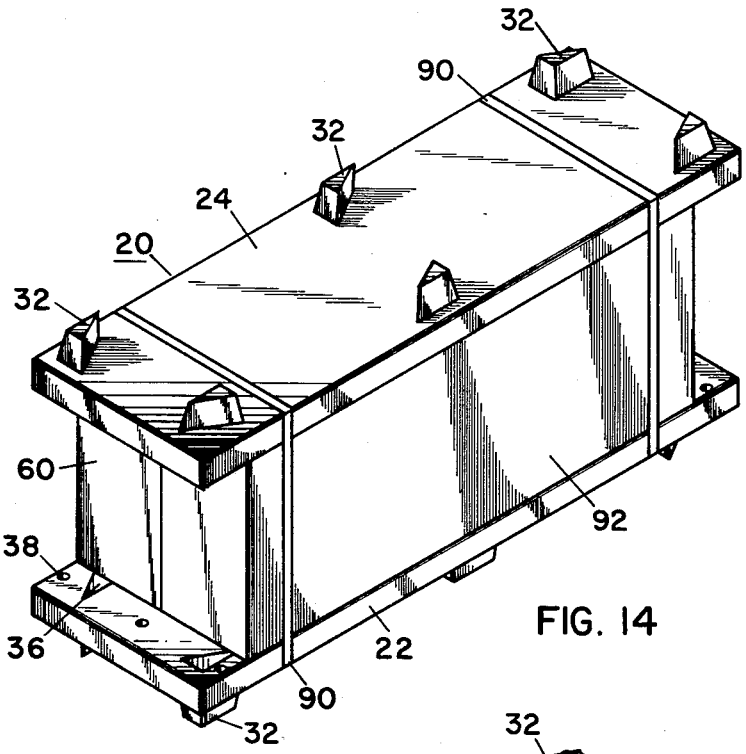
FIG. 14 is a perspective view of a strapped shipping container according to this invention.

FIG. 14 shows a shipping container 20 which is held together by means of strapping 90, which includes any desired number of straps (two are shown) extending transversely around the container 20 in engagement with the pallets 22 and 24. The container illustrated in this figure is the same as that shown in FIG. 1, except that a pair of side closure members 92 of plywood or the like (which may be omitted) are shown. The container shown in this figure is the same as that shown in FIG. 1.

Figure 15:
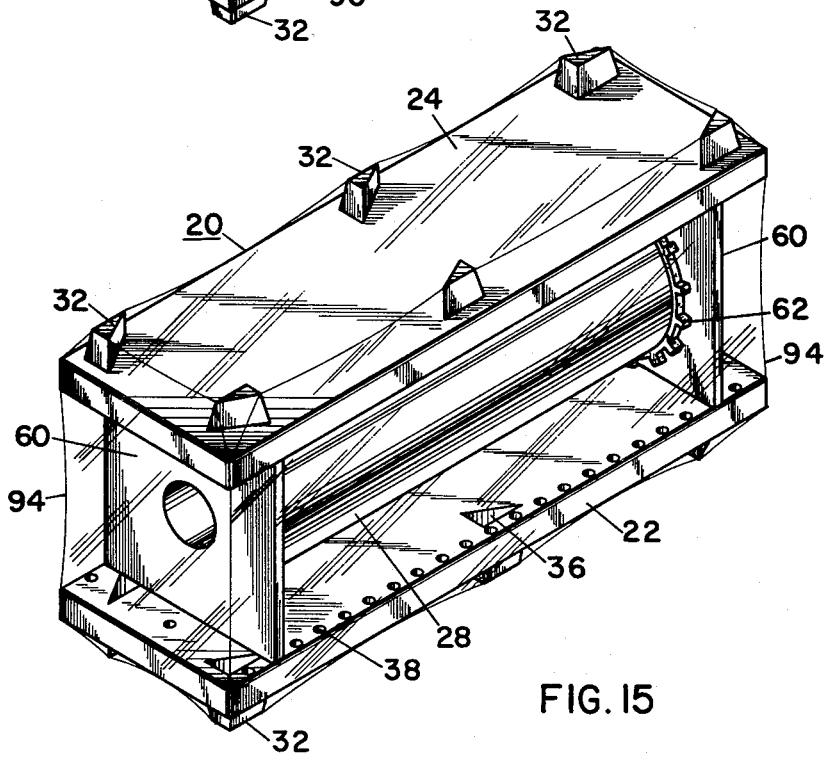
FIG. 15 is a perspective view of a shrink wrapped container according to this invention.

FIG. 15 shows a shipping container 20 which is held together and enclosed by shrink wrapping 94. The container shown in this figure is the same as that shown in FIG. 1.

Figure 16:
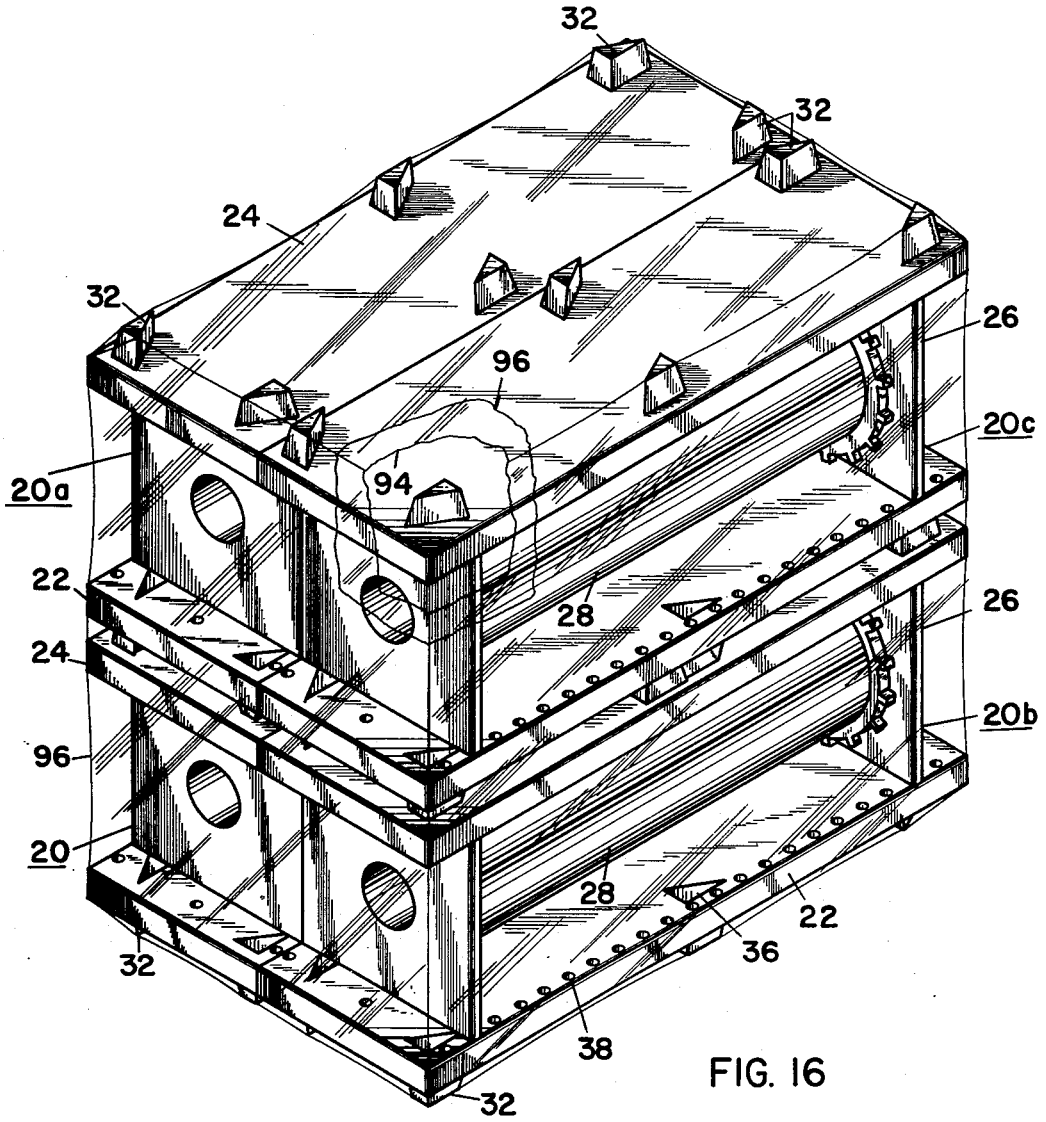
FIG. 16 is a perspective view of a shrink wrapped multiple unit shipping assembly according to this invention, with portions of both the inner and outer shrink wraps removed.

A multiple shipping container assembly can be unitized by shrink wrapping as shown in FIG. 16. Referring now to FIG. 16, there is shown a multiple shipping container assembly comprising shipping containers 20, 20*a,* and 20*c,* which are individually wrapped with sheets 94 of shrink wrap material. The individual containers are as shown in FIG. 1. The assembly is unitized by an overwrap sheet 96 of shrink wrap material, which is wrapped around the entire assembly and bonded by heat sealing to each of the shrink wrap sheets 94.

An assembly of pallets and end plates for return to the shipper is shown in FIG. 17. Referring now to FIG. 17, the assembly 100 includes two stacks 102 and 104 of pallets 22 (four pallets are shown in each stack) and a plurality of end plate assemblies 26 (eight are shown). The upright pallets in the lower stack 102 are nested with their legs 32 extending downwardly and with the legs of each pallet except the lowest fitting into the triangular holes 36 of the pallet below it. The inverted pallets of the upper stack 104 are nested together in the same manner with their legs 32 extending upwardly. Between the two stacks of pallets are the end plate assemblies 26. The end plate assemblies 26 are disposed vertically and in spaced parallel relationship by placing the dowel pins (shown in FIG. 11) of the end plates into holes 38 of pallets 22 in the same manner as illustrated in FIG. 1. The assembly may be held together by strapping 90, or alternatively by shrink wrap or by wire and rope.

The shipping container of the present invention is sturdy, which minimizes the risk of damage to the sheet or film material being shipped. This represents a major advantage compared to boxboard shipping containers. The unique pallet structure of this invention permits interengaging of pallets for shipment and nesting for return. In addition, pallets and end plates can be joined together in a single assembly for return. This encourages the purchaser of the roll goods to return the pallets to the shipper rather than to discard them or use them for other purposes. Another advantage of the present invention is that a single size of shipping container can be used for a wide range of widths of sheet or film material.

Various modifications will occur to those skilled in the art. The shipping container 20 can be made of either wood metal, high density plastic, or foamed structural plastic. Elongated articles (especially core-supported articles) other than rolls of flexible material can be shipped using the shipping container described herein, although this shipping container is particularly suited to shipping heavy rolls. The pallet legs or skids can have various cross-sectional shapes and configurations, provided the shape and configurations are such that each leg or skid has a surface that will bear against a surface of a leg or skid of another pallet when one pallet is in upright orientation (legs down) and the other pallet is inverted (legs up). The end plate assemblies can have means other than the screw threads shown for holding the disc and end plates in desired spaced relationship. For example, an eccentric cam locking collar, set screws, a ratchet and pawl, or other means, can be used. Other modifications will occur to those skilled in the art.

I claim:

1. A shipping container for shipping an elongated article comprising upper and lower rigid pallets, a pair of spaced upright end plate assemblies between said pallets and in engagement therewith, said end plate assemblies including means extending inwardly for supporting said elongated article therebetween, said pallets being of similar structure and each comprising (a) a platform, (b) support means extending outwardly from one side of said platform, the support means of the lower pallet extending downwardly and supporting the container, said support means being arranged so as to permit interlocking engagement between the support means of two similar but oppositely oriented pallets and thereby permit vertical stacking of a plurality of shipping containers, (c) first means on a surface of each pallet extending from one end of said pallet toward the center thereof for receiving one of said end plate assemblies and second means on a surface of each pallet extending from the other end of said pallet toward the center thereof for receiving the other of said end plate assemblies, each of said means comprising a plurality of longitudinally spaced end plate-engaging means, each of said end plate-engaging means being capable of engaging an end plate and retaining it in a desired position whereby each end plate can be placed in any one of a plurality of positions independently of the other end plate in accordance with the length of the elongated article.

2. A shipping container according to claim 1 in which said first and second means comprise a plurality of holes arranged in longitudinally extending rows, the holes in each row being spaced apart, for receiving projections on said end plate assemblies.

3. A shipping container according to claim 1 in which each of said end plate assemblies comprises an end plate, a disc disposed inwardly of said end plate and movable toward or away from said end plate for engaging one end of said elongated article to retain the same in position, and a shaft for guiding the movement of said disc.

4. A shipping container according to claim 1 in which said elongated article is a roll of flexible sheet or film material.

5. A shipping container according to claim 1 in which said pallets include means for permitting nesting of a plurality of like oriented similar pallets and in which said first and second means permit the placement of more than two end plate assemblies in spaced parallel relationship for return.

6. A shipping container for shipping an elongated article comprising upper and lower rigid pallets and a pair of spaced upright end plate assemblies, said end plate assemblies including means extending inwardly for supporting said elongated article there between, said pallets being of similar structure and each comprising a platform and support means extending outwardly from one side of said platform, the support means of the lower pallet extending downwardly and supporting the container, said support means being arranged so as to permit interlocking engagement between the support means of two similar but oppositely oriented pallets and thereby permit vertical stacking of a plurality of shipping containers, said end plate assemblies comprising an end plate, a rotatable disc movable toward or away from said end plate, an externally threaded shaft perpendicular to said end plate and said disc for guiding the movement of said disc, said shaft being affixed to either said plate or said disc, the other having an internally screw threaded central opening for receiving said shaft, whereby said disc moves relative to said end plate as it rotates, and means extending away from said end plate and said disc for supporting one end of the elongated article.

* * * * *

UNITED STATES PATENT AND TRADEMARK OFFICE

CERTIFICATE OF CORRECTION

PATENT NO. : 4,042,107

DATED : August 16, 1977

INVENTOR(S) : Robert N. Kendig

It is certified that error appears in the above-identified patent and that said Letters Patent are hereby corrected as shown below:

Column 2, lines 12 and 13, "compar-ing" should read --comprising

Column 4, line 41, "26" should read --36--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*